US007069678B2

(12) United States Patent
Kaneko et al.

(10) Patent No.: US 7,069,678 B2
(45) Date of Patent: Jul. 4, 2006

(54) BADGE AND BADGE MANUFACTURING DEVICE

(75) Inventors: Kenji Kaneko, Tokyo (JP); Kaori Ojima, Tokyo (JP); Kenetsu Kikuchi, Nagareyama (JP); Iwakichi Ogawa, Nagareyama (JP)

(73) Assignees: Bandai Co., Ltd., Tokyo (JP); Kikuchi Co., Ltd., Chiba (JP)

( * ) Notice: Subject to any disclaimer, the term of this patent is extended or adjusted under 35 U.S.C. 154(b) by 3 days.

(21) Appl. No.: 10/343,543

(22) PCT Filed: Jun. 25, 2002

(86) PCT No.: PCT/JP02/06361

§ 371 (c)(1),
(2), (4) Date: Oct. 7, 2003

(87) PCT Pub. No.: WO03/70045

PCT Pub. Date: Jun. 25, 2002

(65) Prior Publication Data

US 2005/0060925 A1 Mar. 24, 2005

(30) Foreign Application Priority Data

Feb. 19, 2002 (JP) ..... 2002-42396
Jun. 10, 2002 (JP) ..... 2002-169258
Jun. 12, 2002 (JP) ..... 2002-172100

(51) Int. Cl.
*A44C 3/00* (2006.01)

(52) U.S. Cl. ..... 40/1.5; 63/20
(58) Field of Classification Search ..... 40/1.5, 40/1.6; 63/20; 24/114.9, 90.1
See application file for complete search history.

(56) References Cited

U.S. PATENT DOCUMENTS 1,765,325 A * 6/1930 Day ..... 40/1.5

(Continued)

*Primary Examiner*—Gary C. Hoge
(74) *Attorney, Agent, or Firm*—Lewis Brisbois; Bisgaard & Smith LLP; Sanford Astor

(57) ABSTRACT

The present invention relates to a badge where it is possible to select the attachment position of attachment means such as a detachable pin while confirming orientation of a representation attached to a badge body, and a badge manufacturing device that is lightweight and robust, and that can be operated even at an unstable location and in a small space.

A badge 200 comprises a badge body 200*a* having a front cover 201, a sheet body 213 mounted on a front surface plate 202 of the front cover 201, and a rear cover 205 for engaging with the front cover 201 to sandwich a peripheral edge of the sheet body 213 between the rear cover peripheral edge 209 and the front cover peripheral edge 203, and mounting means 229, 237 for linking to the badge body 200*a* by selecting a direction to cross the rear surface plate 206 of the badge body 200*a* (X direction, Y direction or Z direction). A badge manufacturing device 1 comprises a base 2, a sliding platform 100 provided on the base to be capable of reciprocating movement, first and second pressed molds 110 and 140 provided on both sides of the sliding platform 100 in the reciprocating directions, a pressing screw shaft 30 capable of moving in the axial direction by screwing into a female screw section provided on a fixing member 20 fixed to the upper part of the base via struts 16 and 17, a pressing mold 40 provided on a lower end of the pressing screw shaft 30 for joining to the first pressed mold 110 or the second pressed mold 140, and an operating handle 32 provided on an upper part of the pressing screw shaft 30

3 Claims, 19 Drawing Sheets

U.S. PATENT DOCUMENTS 3,141,211 A * 7/1964 Blake ..... 24/114.9
3,715,781 A * 2/1973 Salvatori ..... 24/114.9
4,597,206 A * 7/1986 Benson ..... 40/1.5
4,604,819 A * 8/1986 Grey ..... 40/1.5
4,777,744 A * 10/1988 Barnett ..... 40/1.6
5,067,265 A 11/1991 Harms
5,103,579 A * 4/1992 Mayers ..... 40/1.5
5,283,966 A * 2/1994 Rader et al. ..... 40/1.5
5,457,852 A * 10/1995 Liu ..... 24/13
6,269,574 B1 * 8/2001 Sokolofski ..... 40/668

* cited by examiner

BADGE AND BADGE MANUFACTURING DEVICE

TECHNICAL FIELD

The present invention relates to a badge comprising a badge body having a representation of characters, a design or pattern attached, and attachment means such as a removable pin enabling attachment of the badge to clothing, a hat etc., and to a device for manufacturing such a badge.

BACKGROUND ART

As shown in FIG. 19(*a*) and (*b*), a badge of the related art comprises a badge body 200*a* having a representation 215 of characters, a design or pattern attached, and attachment means 229 such as a removable pin enabling attachment of the badge to clothing or a hat etc. The badge body 200*a* is made up of a rear cover 205 and a front cover 201, and is formed so that the peripheries of design paper 211 and a transparent cover body (sheet body) 213 provided on an upper surface of the front cover 201 are inserted between an edge 203 of the front cover 201 and an edge 209 of the rear cover 205. A representation 215 of characters, a design or a pattern etc. is printed on the design paper 211. Mounting means 260 such as a pair of holes 261, 261, for mounting attachment means 229 such as a removable pin are formed in the rear cover 205. This related art badge is manufactured using a manufacturing device such as that disclosed in Japanese Patent Laid-open No. Sho. 61-32005.

This manufacturing device comprises a base, an arm fixed to the base, a pressing mold assembly attached to a tip of the arm and being moved up and down by a handle, a plate provided in a freely rotatable manner on the base, and first and second pressed mold assemblies provided on the plate. The pressing mold assembly is moved up and down by a pinion rotated by the handle and rack for engaging with the pinion. Also, the badge has a pair of holes for mounting a removable pin formed in the rear cover 205.

Since the above described badge of the related art has attachment means 229 fixed to mounting means such as the pair of holes 261, 261 formed in the rear cover 205, a positional relationship between the orientation of the representation 215 attached to the badge body 200*a* and the attachment means such as the detachable pin for attaching to an item the badge is to be worn on is fixed, and there is a problem in that it is not possible to select the mounting position of the attachment means 229 with respect to the orientation of the representation 215. With the above described related art badge manufacturing device for manufacturing this badge of the related art, when manufacturing the badge body 200*a* there are times when a positional relationship between the orientation of the representation 215 attached to the badge body 200*a* and the mounting means 260, such as a pair of holes 261, 261 etc. formed on the rear cover 205 becomes inappropriate (for example position of the mounting means 260 becomes inclined with respect to the orientation of the representation 215, refer to FIG. 19(*c*)), and in these cases the position of the attachment means 229 attached to the mounting means 260 with respect to the orientation of the representation 215 is also inappropriate and when mounting the badge on an item the badge is to be worn on using the mounting means 229 the representation is inappropriately inclined. This means that the badge body 200*a* must be manufactured while confirming the positional relationship between the orientation of the representation 215 and the mounting means 260, and for that reason manufacture of the badge body 200*a* was difficult. Also, the badge of the related art has a problem that the attachment means 229 attached to the badge body 200*a* is decided and it is not possible to attach by selecting one from a plurality of attachment means.

Since the above described badge manufacturing device of the related art has a problem with strength, each of the components such as a base and an arm are made of cast metal, which is heavy, and there is a problem of high cost. Force to press down the arm is also required, and since this lowering force acts on the base, if the position where the base is placed is not stable it will not be possible to perform the operation, and if operation is carried out on an unstable operating platform there is a possibility that it will slide off the operation platform and break. Also, with the badge manufacturing device of the related art, there is a problem that it is difficult to manufacture the badge while conforming the orientation of the design paper attached to the front cover and the position of the pair of holes formed in the rear cover. For this reason, when the removable pin was fitted into the pair of holes there was a problem in that a badge would be manufactured having an inappropriate positional relationship between the detachable pin and the design paper.

The present invention has been conceived in view of the above described problems, and a first object of the invention is to provide an novel badge in which, at the time of fitting attachment means to a badge body, it is possible to select the attachment position of the mounting means according to orientation of representation attached to the badge body. A second object of the invention is to provide an novel badge where it is possible to selectively attach one mounting means selected from a plurality of mounting means such as a detachable pin, a clip, a magnet or the like. A third object of the present invention is to provide a badge manufacturing device that can be made lightweight, solid and at low cost, does not take up much space and can be operated in an unstable installation location, and which can even be used by a child.

DISCLOSURE OF THE INVENTION

In order to achieve the first object described above, a badge of claim 1 has a badge body, comprising a cover, having a substantially circular front surface plate and a cover edge extending further down than the front surface plate, a sheet body mounted on the front surface plate of the cover, and a rear cover, being a rear cover having a substantially circular rear surface plate and a cover edge extending further down than the rear surface plate, gripping an edge of the sheet body between the rear cover edge and the cover edge so as to cause the sheet body to be tightly connected to the front surface plate, fitting in to the cover, and mounting means, being means for mounting the badge on an item such as a bag, relating to crossing of the rear cover plate and for selectively connecting to the badge body after formation of the badge body by fitting the rear cover and cover together.

In order to achieve the above described first object, a badge of claim 2 has a design paper printed with a representation that is characters, a pattern or a design, or a combination of these, placed between the front surface plate of the cover and the sheet body, and selection of orientation of crossing of the rear surface plate by the mounting means is determined using appropriateness of the representation in the case where the mounting means has been mounted at an appropriate position of an object the badge is worn on.

In order to achieve the above described second object, a badge of claim 3 comprises a badge body fitted with a representation that is characters, a pattern or a design, or a combination of these, two or more types of mounting means capable of mounting the badge on an object on which the badge is worn, such as clothing, a hat, or a bag, and linking means for selecting one of the two or more types of mounting means and capable of connecting the selected mounting means to the badge body.

In order to achieve the above described second object of the invention, a badge of claim 4 has mounting means selected from a detachable pin, a clip, a magnet or the like.

In order to achieve the above described first and second objects, a badge of claim 5 has connection of the mounting means that is mounting holes formed in a substantially central part of the rear cover plate and a mounting shaft fitting into the mounting holes.

In order to achieve the above described third object, a badge manufacturing device of claim 6 comprises a rear cover with an edge facing upwards and a front cover with an edge facing downwards, for manufacturing a badge having an edge of a front cover bent over by overlapping a design paper on an upper surface of the front cover and a transparent cover body so that the periphery of the design paper and the cover body are gripped between an edge of the front cover and an edge of the rear cover, comprising, a base a slide platform provided capable of reciprocating movement on an upper surface of the base, first and second pressed molds providing on both sides of the slide platform in the reciprocating directions, a fixing member fixed to an upper part of the platform via a strut, a pressing screw shaft, screwed into a female screw thread provided in the fixing member to be movable in the axial direction, and a pressing mold, provided at a lower end of the pressing screw shaft for joining to the first pressed mold and the second pressed mold, and an operating handle provided on an upper part of the pressing pressure screw, wherein, the first pressed mold comprises a first mounting platform for mounting the front cover, and a guide platform, provided at the periphery of the first mounting platform, for mounting a design paper and the cover body in an overlapped manner, the guide platform being provided in such as manner as to be capable of upward and downward movement and being urged upwards by an elastic member, the second pressed mold comprises a second mounting platform for mounting the rear cover, and a processing platform, provided at the periphery of the second mounting platform, for bending an edge of the front cover to a rear cover edge side so that the design paper and the periphery of the cover body are gripped by edge of the front cover and the edge of the rear cover, the processing platform being provided in such as manner as to be capable of upward and downward movement and being urged upwards by an elastic member, the pressing mold comprises an outer layer frame and an inner layer frame provided inside the outer layer frame and being shallower than the outer layer frame, the inner layer frame provided to be rotatable at a lower end of the pressing pressure shaft via an opening formed in an upper end of the outer layer frame, a switching member for switching to the outer layer frame or the inner layer frame pressed by the pressing screw shaft being further provided on the pressing mold depending on the position of the first pressed mold and the second pressed mold, the switching member coming into contact with an upper end of the outer layer frame when the first pressed mold is positioned almost directly below the pressed mold and being pressed by the pressing screw shaft, and moving away from the upper end of the outer layer frame when the sliding platform slides to position the second pressed mold almost directly below the pressing mold and not being pressed by the pressing screw shaft, the pressing screw shaft being moved downwards by operating the operating handle, if the switching member is pressed by the pressing screw shaft the outer layer frame is moved downwards to contact the guide platform of the first pressed mold, the guide platform is pressed down against the elasticity of the elastic member, and the design paper and the cover body are bent along the edge of the front cover, and if the switching member is not pressed by the pressing screw shaft the inner layer frame is moved downwards to contact the processing platform of the second pressed mold, the processing platform is pressed down against the elasticity of the elastic member, and the edge of the front cover is bent to a side of the rear cover edge so that periphery of the design paper and the cover body are gripped by the edge of the front cover and the edge of the rear cover.

BEST MODE FOR CARRYING OUT THE INVENTION

Figure 1:
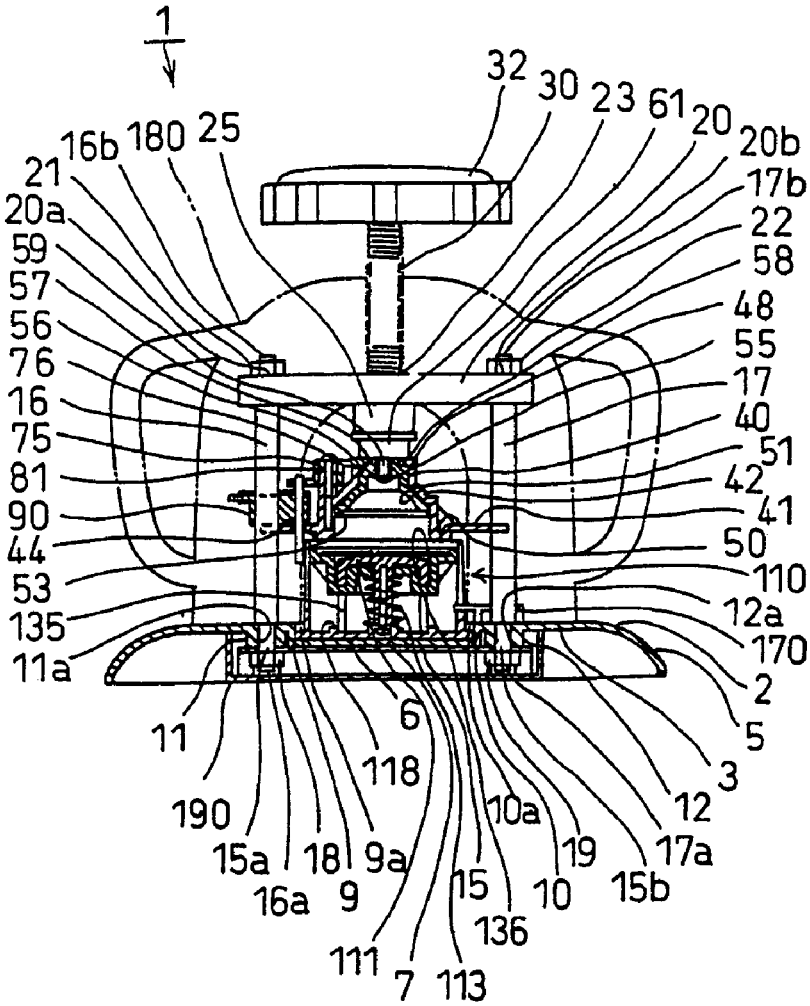
FIG. 1 is an overall front elevation cross section showing a first pressed mold of a badge manufacturing device of the present invention.
Figure 2:
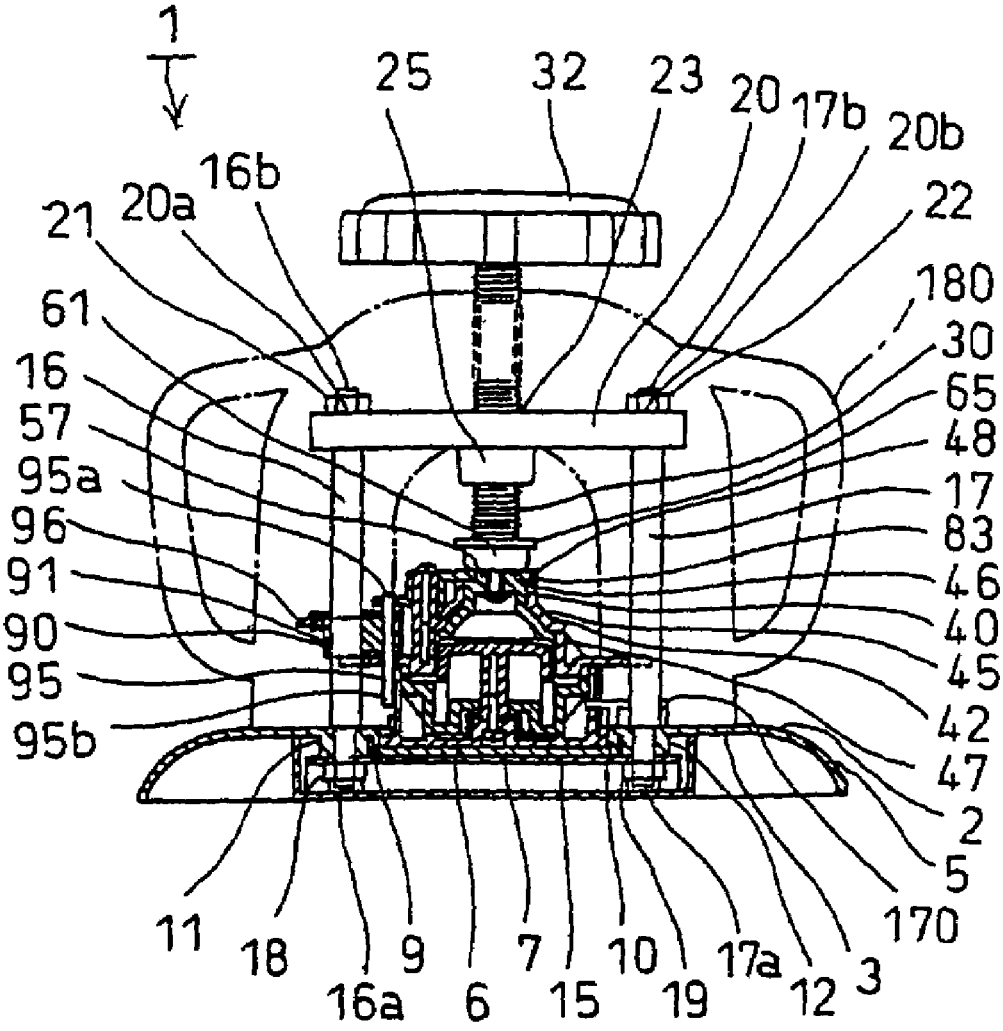
FIG. 2 is an overall front elevation cross section for describing movement of FIG. 1.
Figure 3:
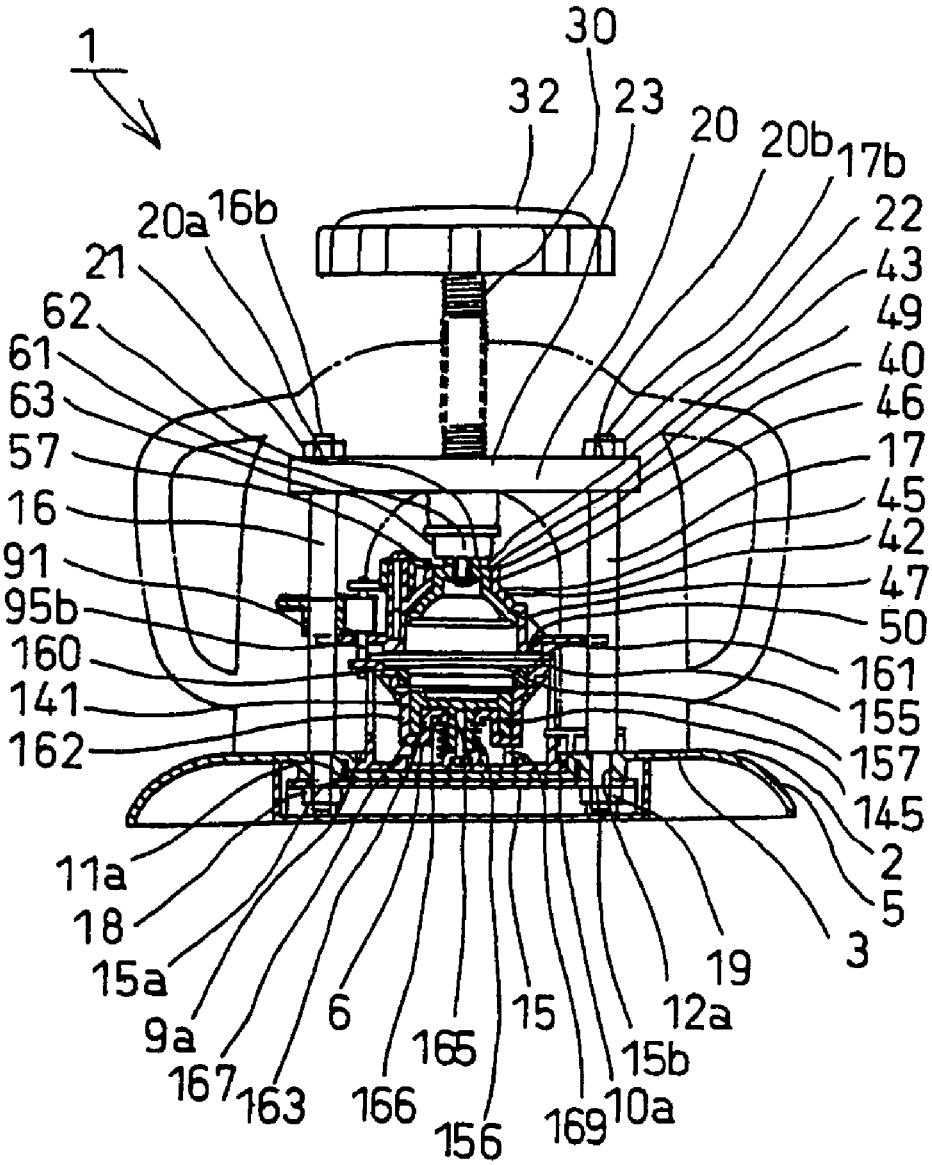
FIG. 3 is an overall front elevation cross section showing a second pressed mold of a badge manufacturing device of the present invention.
Figure 4:
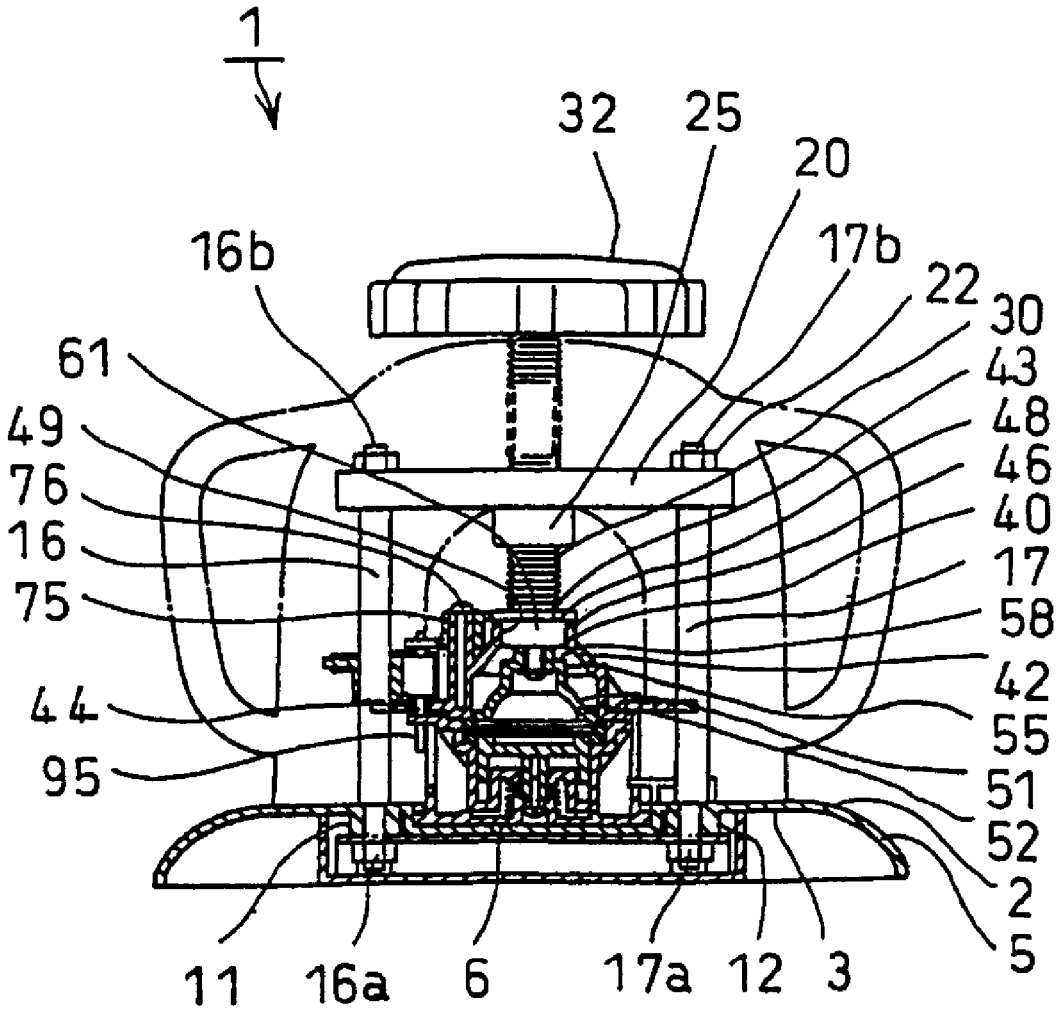
FIG. 4 is an overall front elevation cross section for describing movement of FIG. 3.
Figure 5:
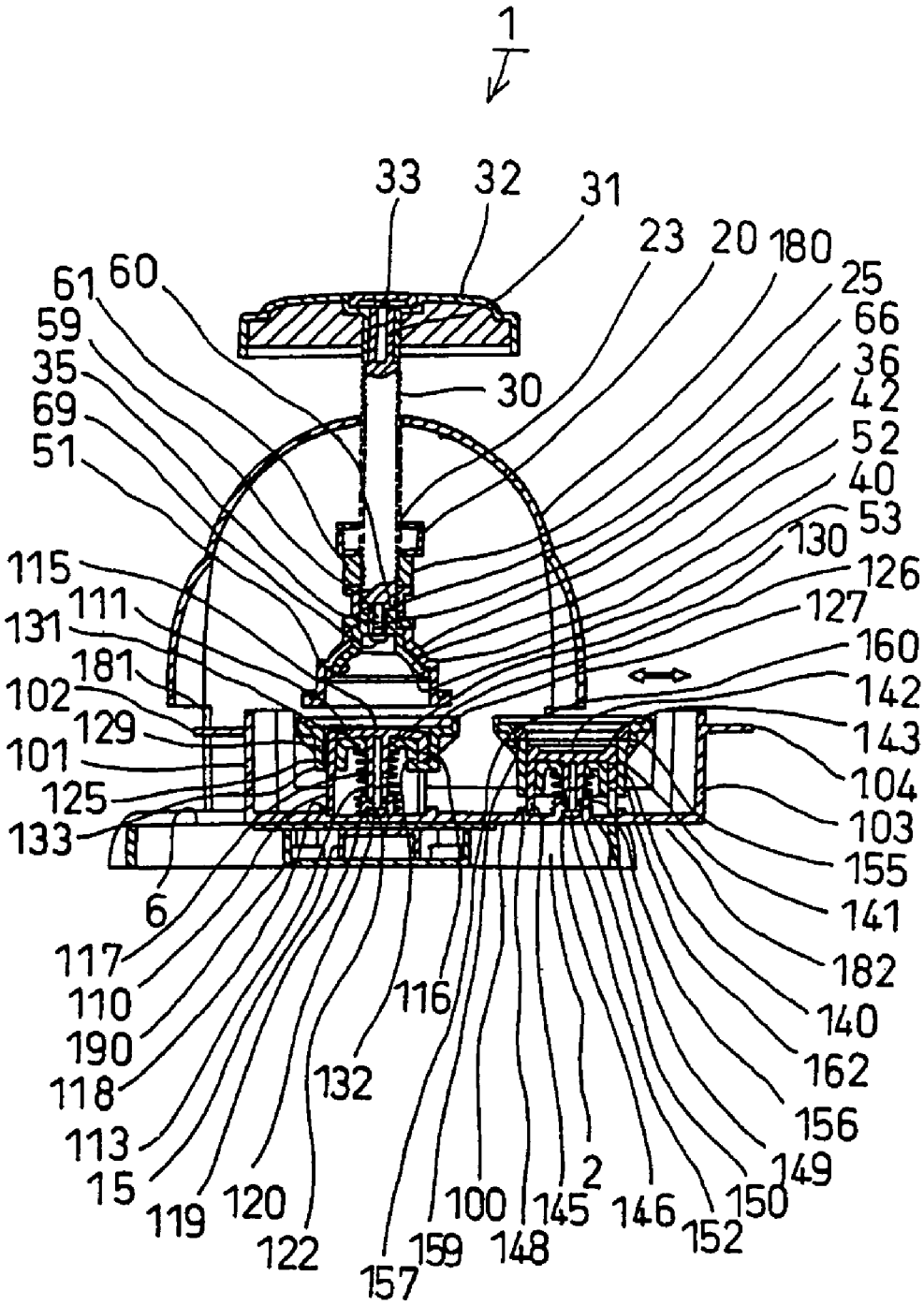
FIG. 5 is an overall side cross section showing a badge manufacturing device of the present invention.
Figure 6:
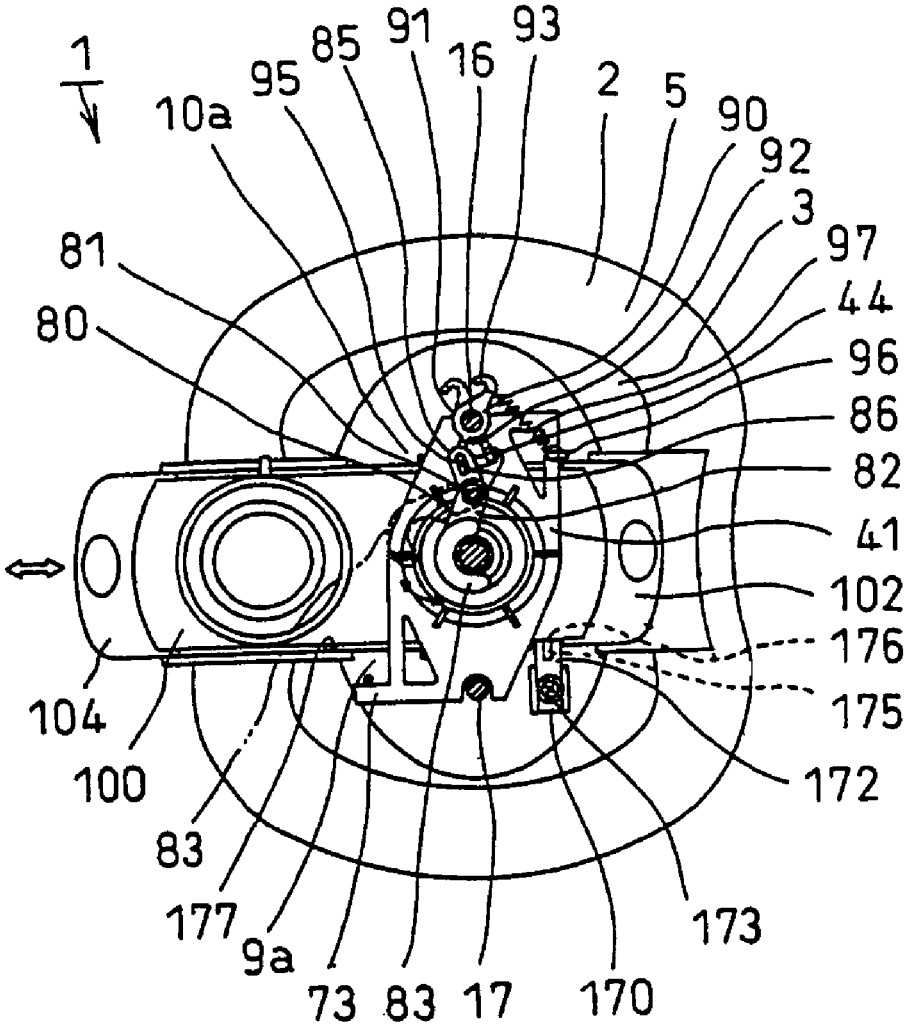
FIG. 6 is an overall plan view of FIG. 5.
Figure 7:
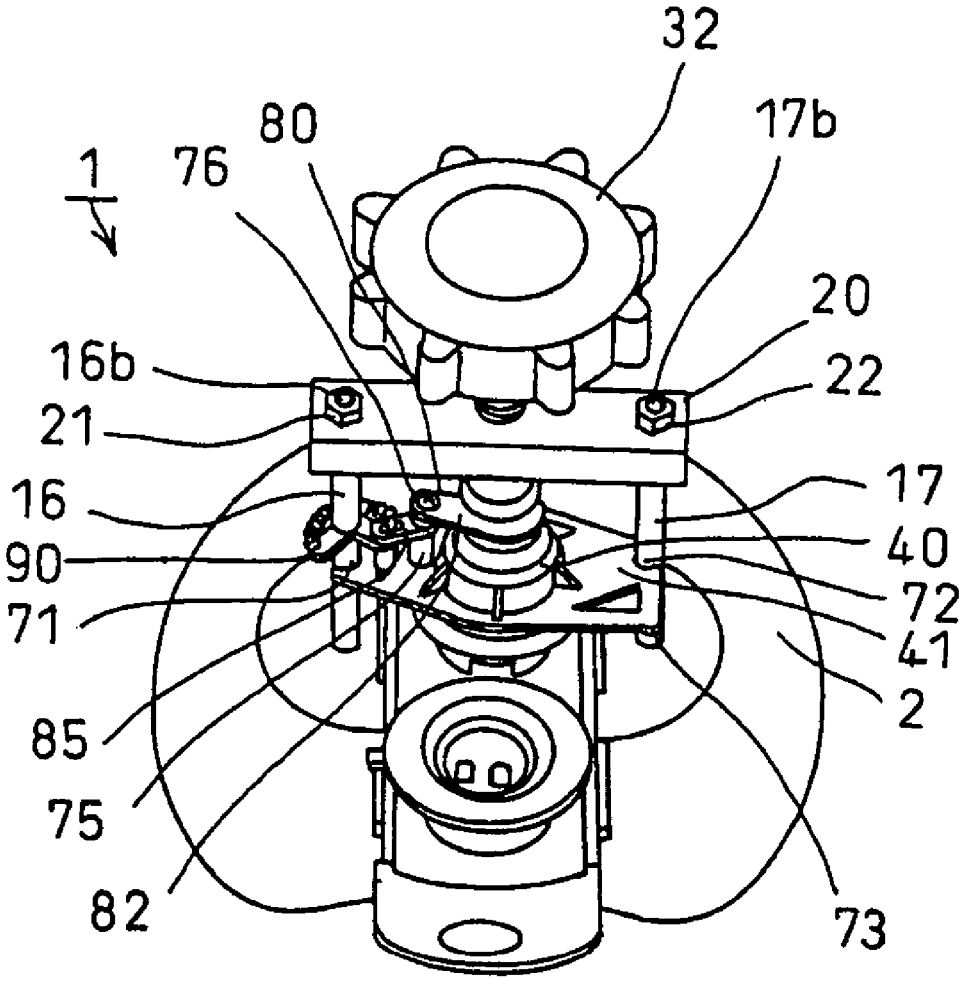
FIG. 7 is an overall perspective view looking from above for describing movement of the badge manufacturing device.
Figure 8:
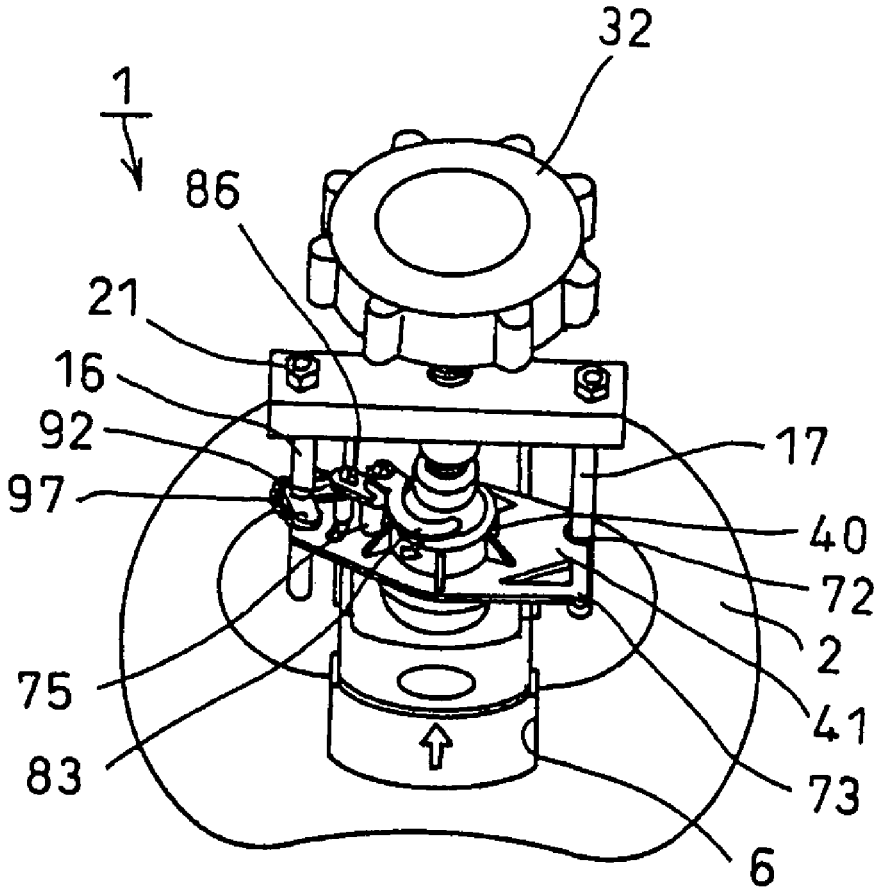
FIG. 8 is an overall perspective view looking from above for describing movement of the badge manufacturing device.

One embodiment of a badge of the present invention will now be described based on FIG. 9 to FIG. 18. A badge 200 comprises a badge body 200*a*, having a front cover 201 having a substantially circular front plate 202 and a front cover edge 203 extending further downwards than the front plate 202, a sheet body 213 mounted on the front plate 202 of the front cover 201, a rear cover 205 with a substantially circular rear plate 206 and a rear cover edge 209 extending further upwards than the rear plate 206, the rear cover 205 fitting into the front cover 201 so that an edge of the sheet body 213 is gripped between the rear cover edge 209 and the front cover edge 203 and the sheet body 213 is brought into tight contact with the front plate 202, and mounting means 229, 237, 246 capable of being mounted on an item the badge is to be worn on, such as clothing, a hat or a bag, the mounting means relating to crossing direction of the rear plate 206 (for example, X direction, Y direction or Z direction—refer to FIG. 9) and selectively connecting with the badge body 200*a* after the rear cover 205 has been fitted into the front cover 201 to form the badge body 200*a*.

Figure 9:
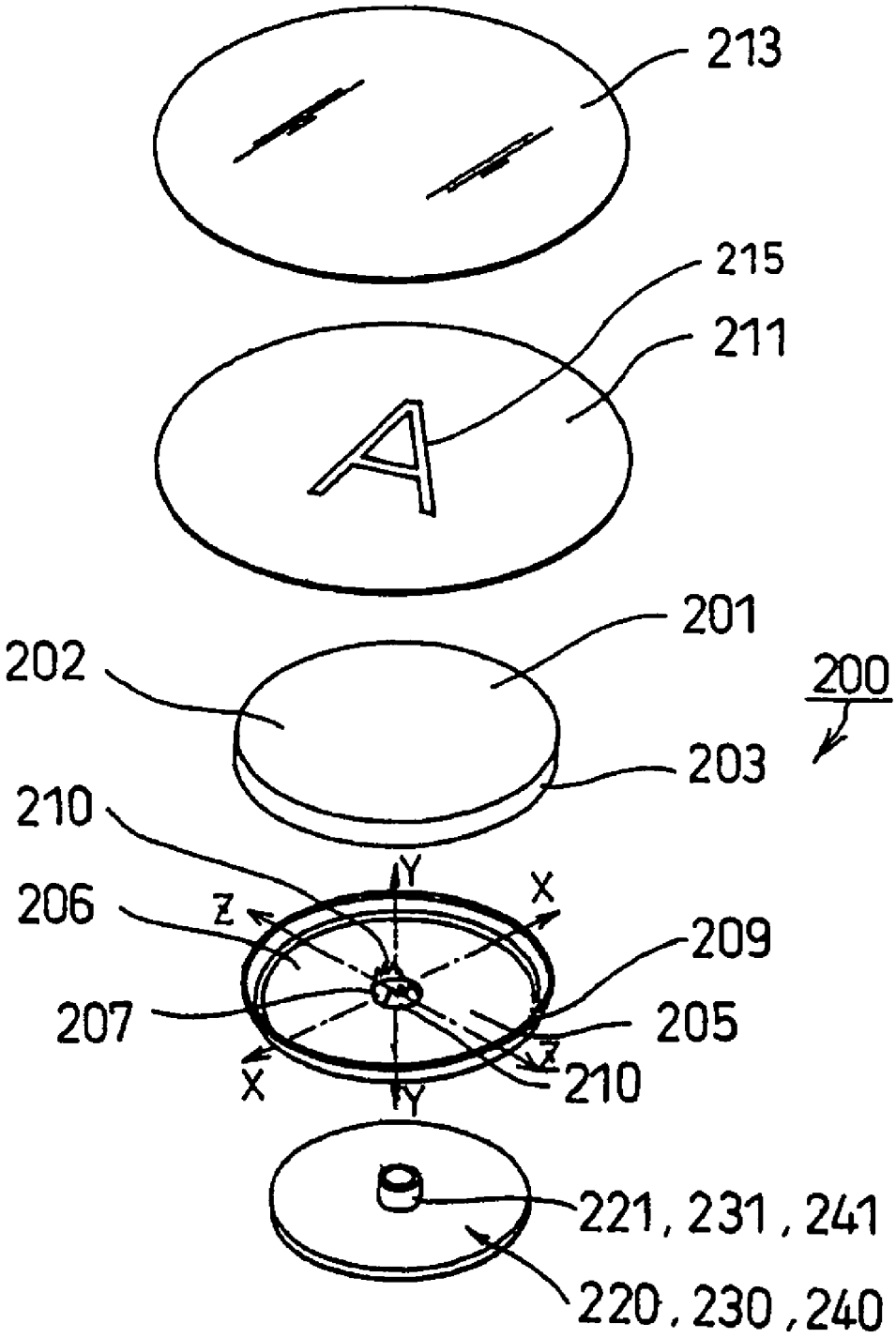
FIG. 9 is an overall exploded view showing a badge of the present invention.
Figure 10:
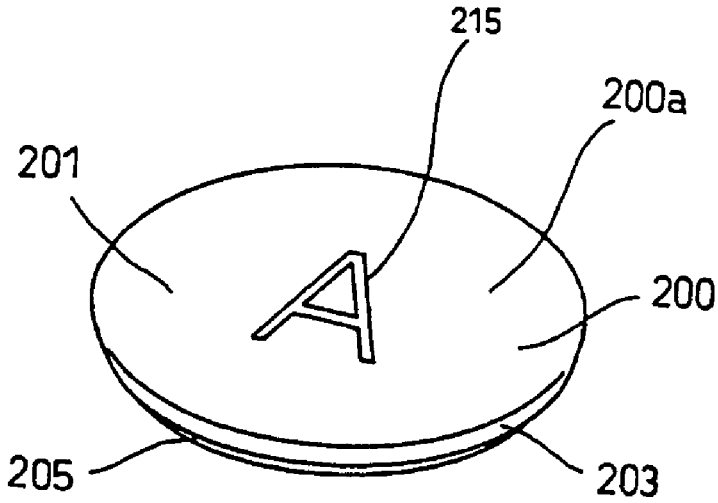
FIG. 10 is an overall perspective view of FIG. 9 assembled.
Figure 11:
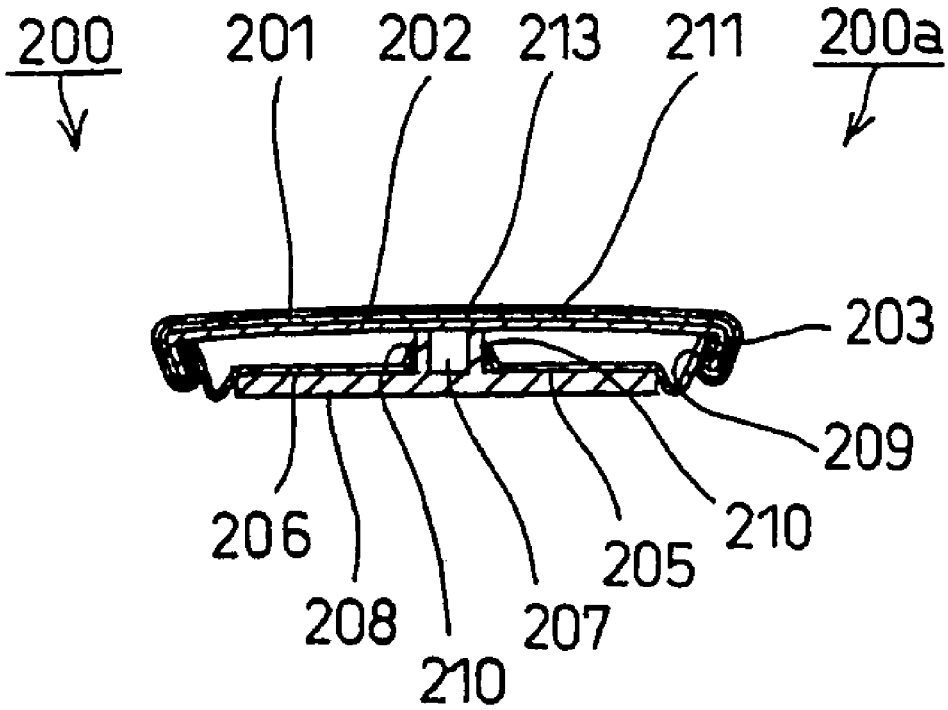
FIG. 11 is a side cross section of FIG. 10.

A design paper 211 printed with a representation 215 such as characters, a pattern, a design or a combination of these is placed between the front plate 202 of the front cover 201 and the sheet body 213, and selection of a direction in which the mounting means 229, 237, 246 transverses the rear plate 206 (for example, X direction, Y direction or Z direction,—refer to FIG. 9) is determined using appropriateness of the representation 213 in the case where the mounting means has been mounted at an appropriate position of the item on which the badge is to be worn.

The badge 200 has the badge body 200*a* to which the representation 215 such as characters, a pattern, a design or a combination of these, at least two types of mounting means 229, 237, 246 capable of mounting the badge on an item the badge is to be worn on, such as clothing, a hat or a bag, and linking means 220, 230, 240 for selecting one from the at least two types of mounting means and capable of connecting the selected mounting means to the badge body 200*a*.

The mounting means is selected from a removable pin 229, a clip 237 or a magnet 246. Connection of the mounting means 229, 237, 246 is an attachment hole 207 formed in a substantially central part of the rear plate 206 and attachment shafts 221, 231, 241 for fitting into the attachment hole 207.

The badge will be described in more detail. The badge 200 comprises the body 200*a*, linking means 220 and the removable pin (mounting means) 229, as shown in FIG. 9. The badge body 200*a* is made up the front cover 201, the rear cover 205, the design paper 211 and a cover body (sheet body) 213. Before processing, the front cover 201 has a curved front plate 202, and a front cover edge 203 is bent at substantially a right angle to face downwards with respect to the front plate 202. Before processing, the rear cover 205 has the rear plate 206 with an attachment hole 207 formed substantially in the center, the rear cover edge 209 bent almost at right angles to face upwards with respect to the rear plate 206, and a circular indentation 208 formed in the rear plate 206.

The design paper 211 is a circular paper sheet, on which is printed a representation 215 that is characters, a pattern, a design or a combination of these, and it can even be a cutting from a magazine or the like. The cover body (sheet body) 213 is formed of this transparent synthetic resin. The badge body 200*a* is made by overlapping the design paper 211 and the cover body (sheet body) 213 on an upper surface of the front cover 201, and bending the edge 203 of the front cover 201 so that the peripheries of the design paper 211 and the cover body (sheet body) 213 are gripped between the peripheral edge 203 of the front cover 201 and the peripheral edge 209 of the rear cover 205, and is formed so that the peripheries of the design paper 211 and the cover body (sheet body) 213 are inserted between the edge 203 of the front cover 201 and the edge 209 of the rear cover 205. It is also possible to print the representation 215 that is characters, a design, a pattern or a combination of these directly on the cover body (sheet body) 213 without using the design paper 211. A pair of latch claws 210, 210 are formed in a protruding manner on an outer edge of the attachment hole 207 facing inwards.

Figure 12:
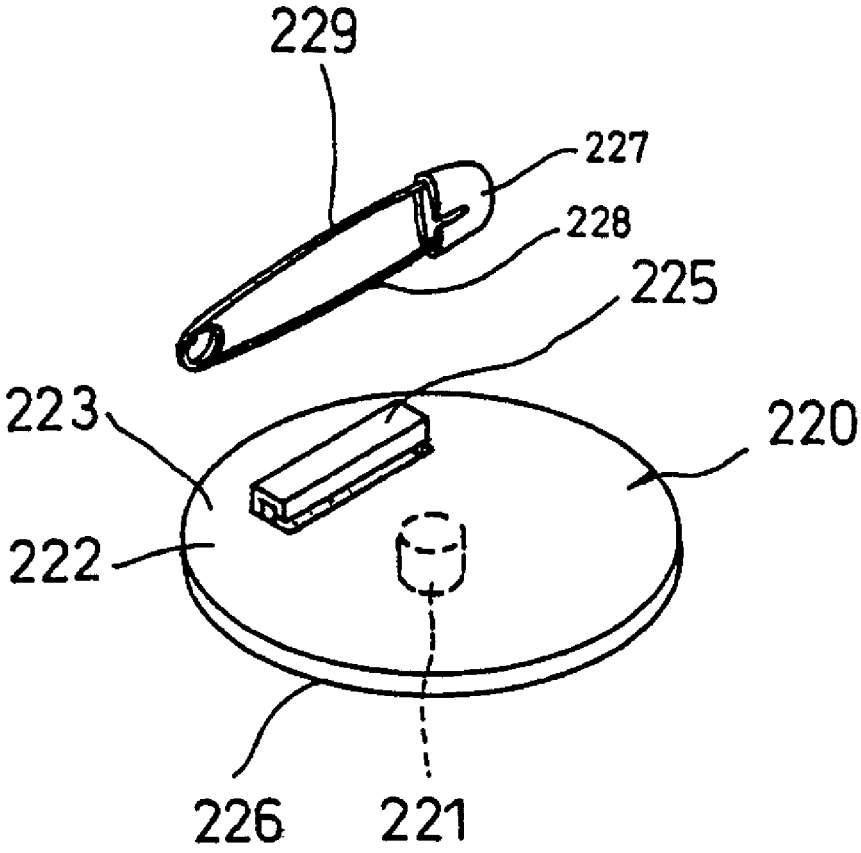
FIG. 12 is a perspective drawing showing one embodiment of mounting means for the badge of the present invention.
Figure 13:
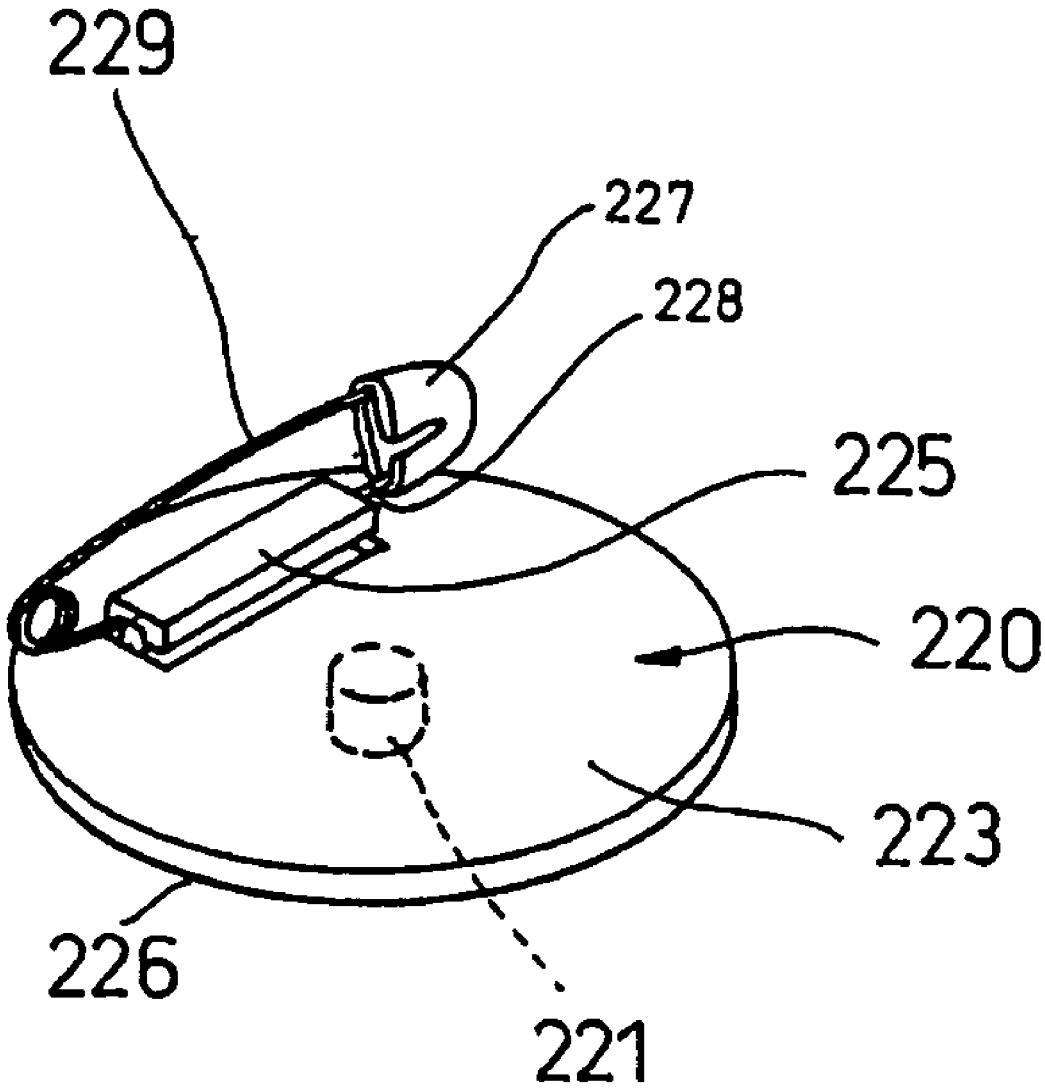
FIG. 13 is a perspective drawing showing the state where the mounting means of FIG. 12 is attached.
Figure 14:
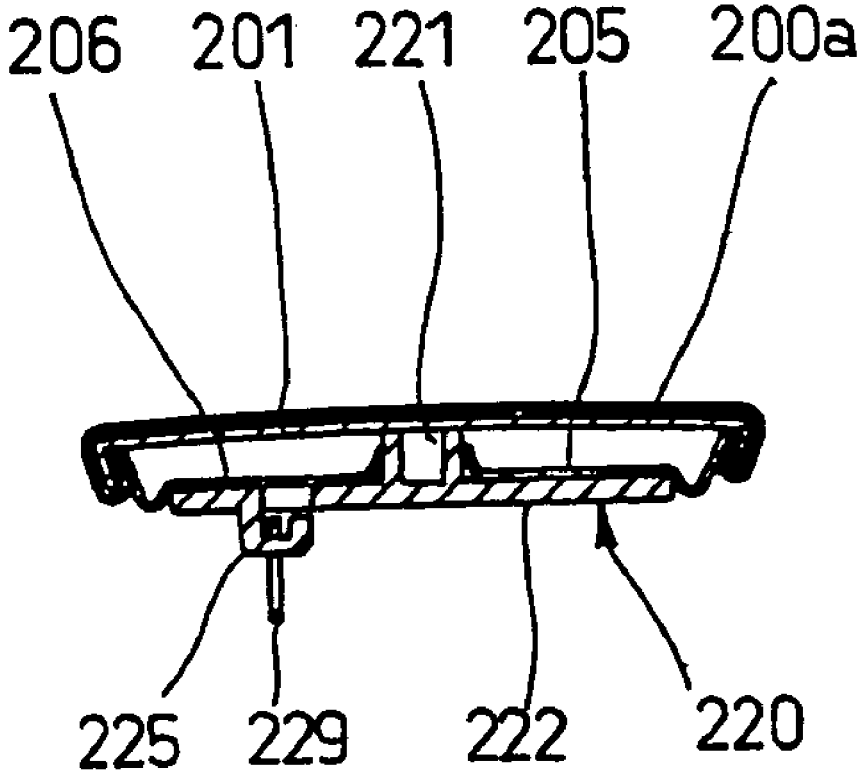
FIG. 14 is a side cross section of a whole badge with the mounting means of FIG. 13 attached to a rear cover.

As shown in FIG. 12 to FIG. 14, the linking means 220 comprises a base plate 222, a substantially L-shaped engagement section 225 formed on the surface 223 of the base plate 222, an attachment shaft 221 formed in a protruding manner at a substantially central part of the rear surface 226 of the base plate 222, and the attachment hole 207 formed in a substantially central part of the rear cover 205. The base plate 222, engagement section 225 and attachment shaft 221 are integrally formed of synthetic resin, and are separate from the badge body 200*a* described above. The base plate 222 is attached to a detachable pin (mounting means) 229 using the engagement section 225, and the attachment shaft 221 is fitted into the attachment hole 207 of the rear cover 205 so that the base plate 222 is engaged with a concave section 208 of the rear cover 205.

In this way, the badge body 200*a* and the detachable pin (mounting means) 229 are linked using the linking means 220. The detachable pin (mounting means) 229 is attached in a direction crossing the rear plate 206 (for example the X direction Y direction or Z direction in FIG. 9). Since it is possible to attach the detachable pin (mounting means) 229 by fitting the attachment shaft 221 into the attachment hole 207 while confirming the orientation of the representation 215 attached to the badge body 200*a*, it is possible to select the attachment direction ((for example the X direction, Y direction, or Z direction in FIG. 9) of the detachable pin (mounting means) 229. If the attachment shaft 221 is fitted into the attachment hole 207 it latches with and is attached to the latch claws 210, 210 formed at the peripheral edge of the attachment hole 207. The detachable pin (mounting means) 229 is capable of rotation with respect to the badge body 200*a*, but if it is only allowed to rotate slightly the attachment shaft 221 will be worn away by the latch claws 210, 210 and it will become easy for the detachable pin (mounting means) 229 to come away from the badge body 200*a*, and so it is preferable for rotation to be as little as possible in order to allow only fine adjustment.

Figure 15:
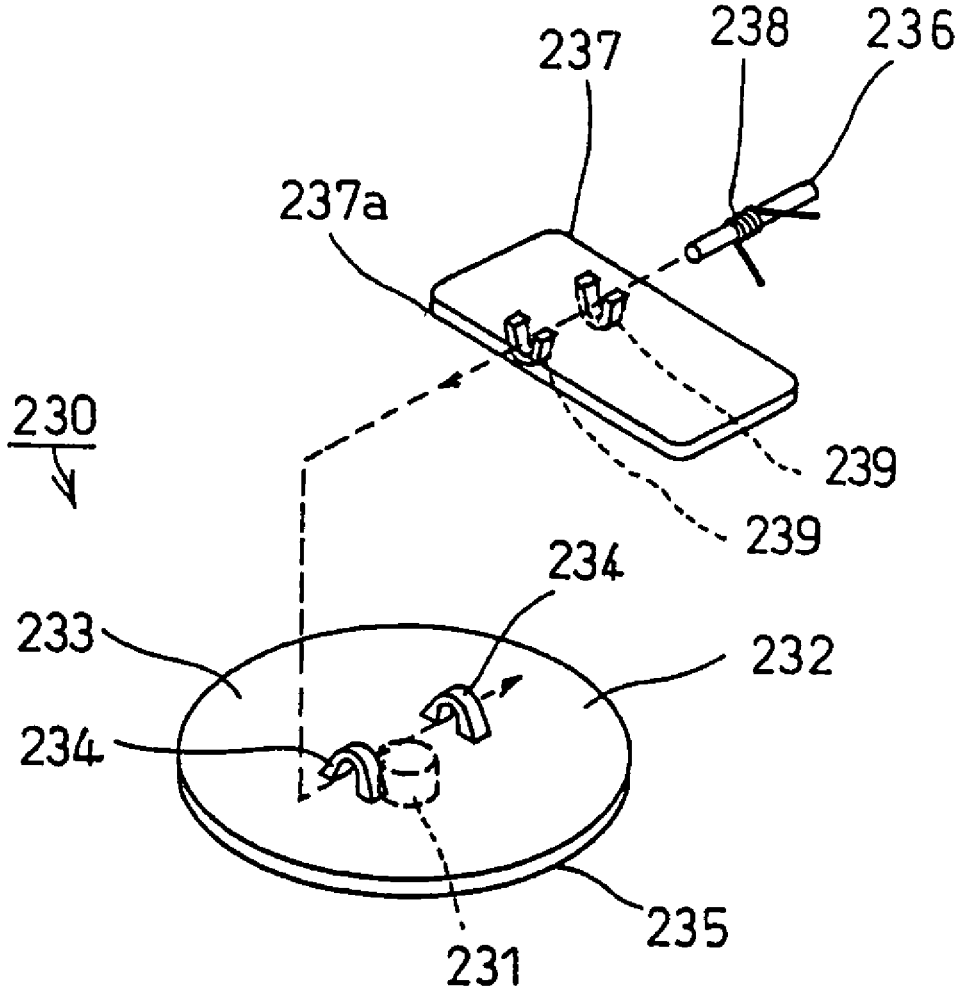
FIG. 15 is a perspective drawing showing another embodiment of mounting means for the badge of the present invention.
Figure 16:
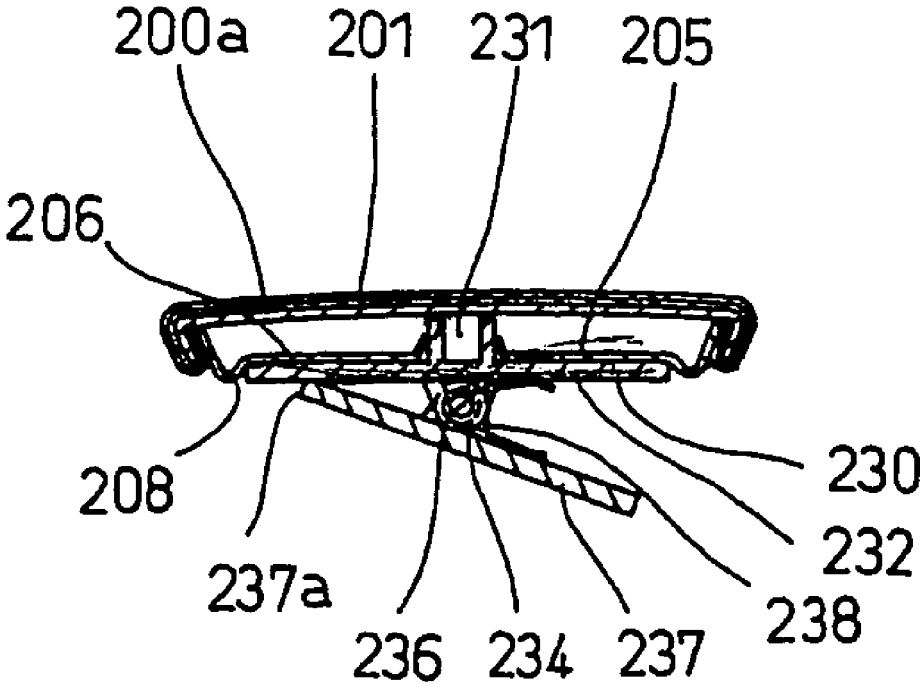
FIG. 16 is a side cross section of a whole badge with the mounting means of FIG. 15 attached to a rear cover.

As shown in FIG. 15 and FIG. 16, the linking means 230 is preferably comprised of a base plate 232, a pair of substantially U-shaped bearing lugs 234, 234 formed substantially in the center of the surface 233 of the base plate 232, an attachment shaft 231 formed in a protruding manner substantially in the center of the rear plate 235 of the base plate 232 of the mounting means comprising a gripping plate 237 having one end 237*a* pressed against the base plate 232 by an elastic member 238 such as a spring, and an attachment hole 207 formed substantially in the center of the rear cover 205. In this case also, the base plate 232 and the attachment shaft 231 are integrally formed of synthetic resin, and is separate from the badge body 200*a*. The gripping plate 237 forms a grip with the one end 237*a* being pressed against the base plate 232 by an elastic member 238.

The attachment shaft 231 is fitted into the attachment hole 207 of the rear cover 205 so that the base plate 232 engages with the indented section 208 of the rear cover 205.

In this way, the badge body 200*a* and the clip-shaped mounting means comprising the gripping plate 237 and the base plate 232 are linked using the linking means 230. The gripping plate (mounting means) 237 is attached in a direction crossing the rear plate 206 (for example, the X direction, Y direction or Z direction of FIG. 9). Since it is possible to attach the gripping plate (mounting means) 237 by fitting the attachment shaft 231 into the attachment hole 207 while confirming the orientation of the representation 215 attached to the badge body 200*a*, it is possible to select the attachment direction (for example the X direction Y direction or Z direction in FIG. 9) of the gripping plate (mounting means) 237.

If the attachment shaft 231 is fitted into the attachment hole 207 it latches with and is attached to the latch claws 210, 210 formed at the peripheral edge of the attachment hole 207. The gripping plate (mounting means) 237 is capable of rotation with respect to the badge body 200*a*, but if it is only allowed to rotate slightly, the attachment shaft 231 will be worn away by the latch claws 210, 210 and it will become easy for the gripping plate (mounting means) 237 to come away from the badge body 200*a*, and so it is preferable for rotation to be as small as possible to enable only fine adjustment.

Figure 17:
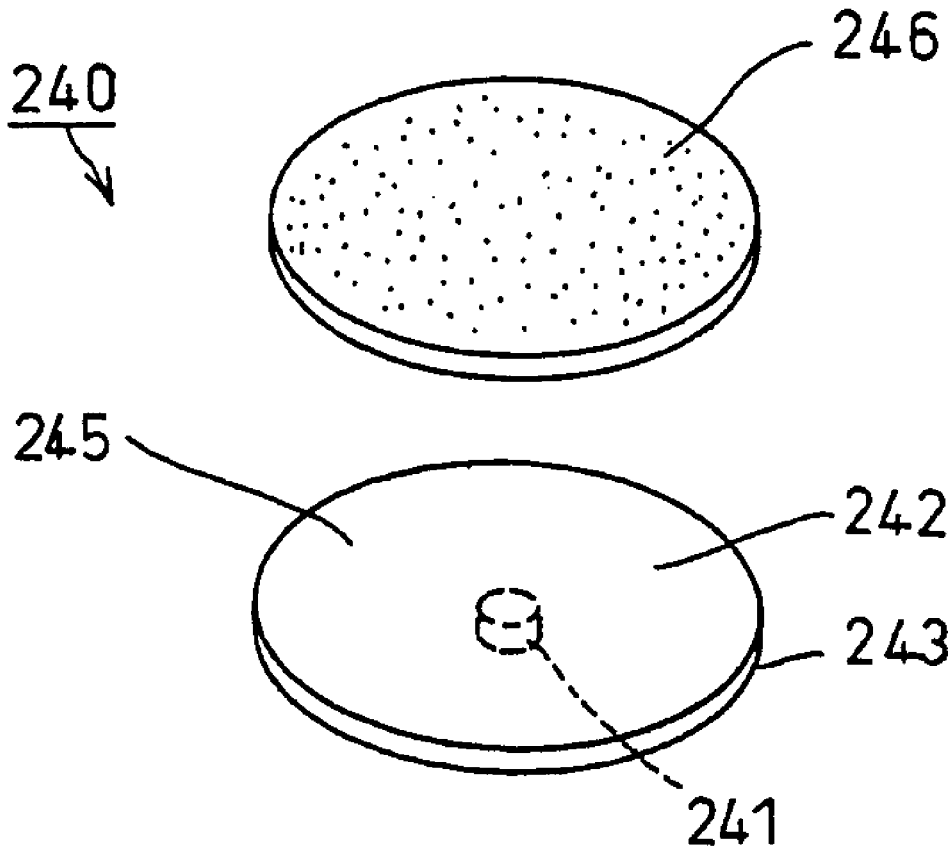
FIG. 17 is a perspective drawing showing another embodiment of mounting means for the badge of the present invention.
Figure 18:
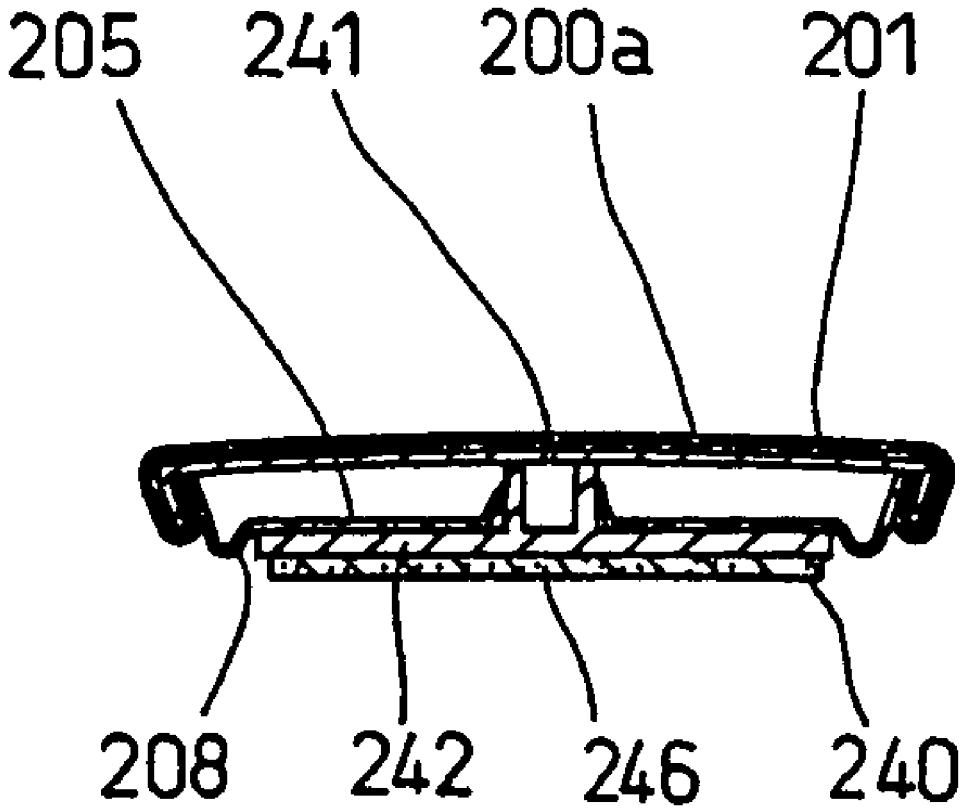
FIG. 18 is a side cross section of a whole badge with the mounting means of FIG. 17 attached to a rear cover.
Figure 19:
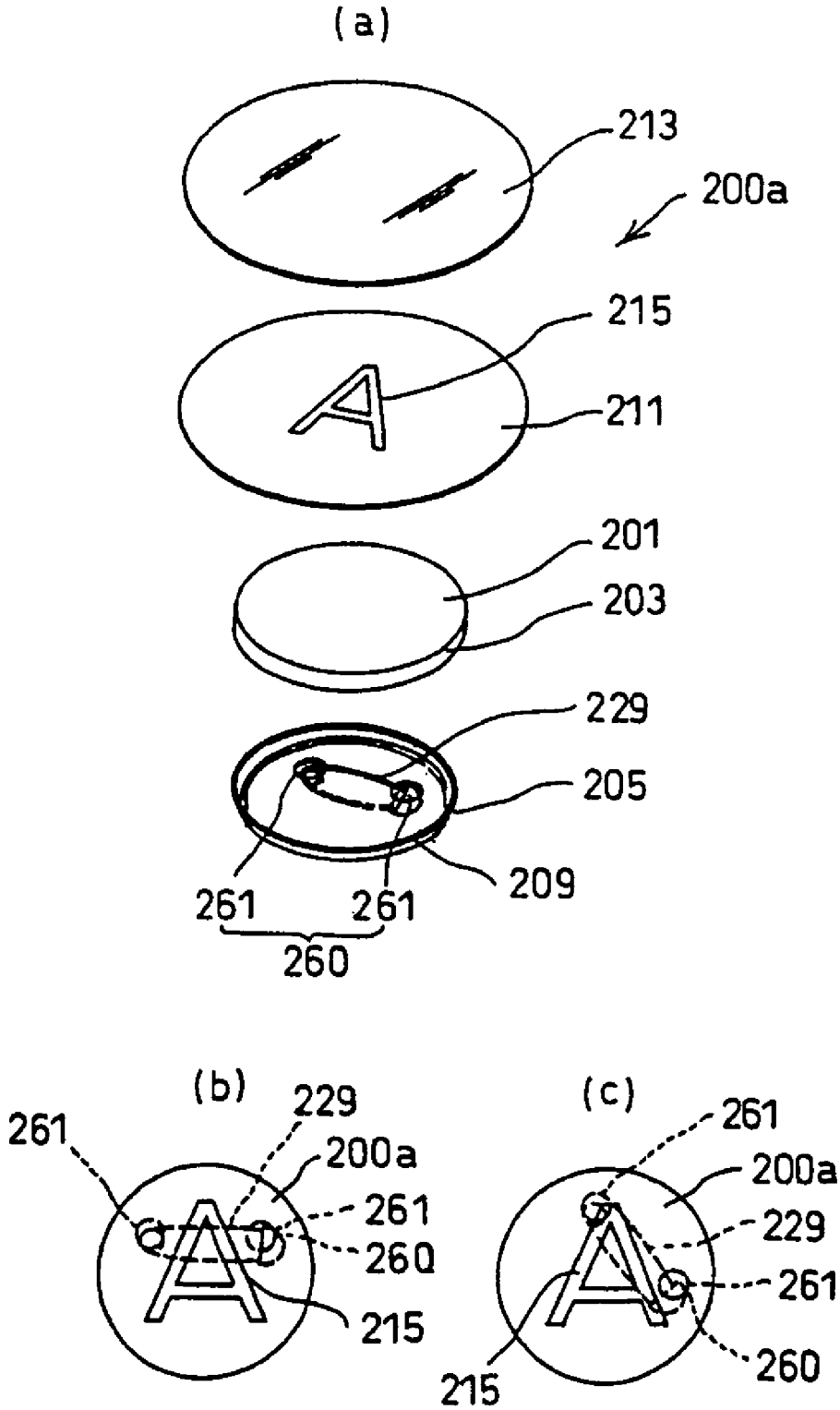
FIG. 19 is an explanatory view for describing a badge of the related art.

As shown in FIG. 17 and FIG. 18, the linking means 240 is preferably comprised of, an attachment shaft 241 formed in a protruding manner substantially in the center of the rear plate 243 of the base plate 242 of the mounting means comprising a base plate 242, a plate shaped magnet 246 attached to the surface 245 of the base plate 232 using adhesive, and an attachment hole 207 formed substantially in the center of the rear cover 205. In this case also, the base plate 242 and the attachment shaft 241 are integrally formed of synthetic resin, and are separate from the badge body 200*a*.

The attachment shaft 241 is fitted into the attachment hole 207 of the rear cover 205 so that the base plate 242 engages with the indented section 208 of the rear cover 205.

In this way, the badge body 200*a* and the plate-shaped magnet (mounting means) 246 are linked using the linking means 240. If the attachment shaft 241 is fitted into the attachment hole 207, it latches with and is attached to the latch claws 210, 210 formed at the peripheral edge of the attachment hole 207. In this way, the badge 200 can be linked to the badge body 200*a* by selecting one from among at least two types of mounting means, for example, the detachable pin 229, clip 237 or magnet 246, using the linking means 220, 230 or 240.

Next, one embodiment of a badge manufacturing device for manufacturing a badge of the present invention will be described based on FIG. 1 to FIG. 8. The badge manufacturing device 1 manufactures the badge body 200*a* made up of a rear cover 205 having a peripheral edge 209 facing upwards and a front cover 201 having a peripheral edge 203 facing downwards, so that the peripheries of the design paper 211 and a transparent cover body (sheet body) 213 overlap on an upper surface of the front cover 201, and bends a peripheral edge 203 of the front cover 201 so that the design paper 211 and the cover body (sheet body) 213 are inserted between an edge 203 of the front cover 201 and an edge 209 of the rear cover 205.

The badge manufacturing device 1 comprises a base 2, a sliding platform 100 provided on one upper surface of the base 2 so as to be capable of reciprocating movement, first and second pressed molds 110, 140 provided on the two sides of the sliding platform 100 in the reciprocating directions, a fixing member 20 fixed to an upper part of the base 2 via struts 16 and 17, a pressing screw shaft 30 moveable in an axial direction by screwing into a female screw section 17*b* provided in the fixing member 20, a pressing mold, provided on a lower end of the pressing screw shaft 30, for engaging with the first pressed mold 110 and the second pressed mold 140, and an operating handle 32 provided on an upper part of the pressing screw shaft 30.

The first pressed mold 110 comprises a first mounting platform 111 for mounting the front cover 201, and a guide platform 125, provided at the periphery of the first mounting platform 111, for mounting a design paper 211 and the cover body (sheet body) 213 in an overlapped manner, the guide platform 125 being provided in such as manner as to be capable of upward and downward movement and being urged upwards by an elastic member 113.

The second pressed mold 140 comprises a second mounting platform 141 for mounting the rear cover 205, and a processing platform 155, provided at the periphery of the first mounting platform 141, for bending an edge 203 of the front cover 201 to a rear cover 205 edge 209 side so that the design paper 211 and the periphery of the cover body (sheet body) 213 are gripped by edge 203 of the front cover 201 and the edge 209 of the rear cover 205, the processing platform 155 being capable of upward and downward movement and being urged upwards by an elastic member 156.

The pressing mold 40 comprises an outer layer frame 42 and an inner layer frame 51 provided inside the outer layer frame 42 and being shallower than the outer layer frame 42, the inner layer frame 51 provided to be rotatable at a lower end of the pressing shaft 30 via an opening 43 formed in an upper end of the outer layer frame 42.

A switching member 80 for switching to the outer layer frame 42 or the inner layer frame 51 pressed by the pressing screw shaft 30 is further provided on the pressing mold 40 depending on the position of the first pressed mold 110 and the second pressed mold 140. The switching member 80 comes into contact with an upper end of the outer layer frame 42 when the first pressed mold 110 is positioned almost directly below the pressed mold 40 and is pressed by the pressing screw shaft 30, and moves away from the upper end of the outer layer frame 42 when the sliding platform 100 slides to position the second pressed mold 140 almost directly below the pressing mold 40 and is not pressed by the pressing screw shaft 30.

The badge manufacturing device 2 causes the pressing screw shaft 30 to be moved downwards by operation of the operating handle 32, and if the switching member 80 is pressed by the pressing screw shaft 30, the outer layer frame 42 is moved downwards to contact the guide platform 125 of the first pressed mold 110, the guide platform 125 is pressed down against the elasticity of the elastic member 113 so that and the design paper 211 and the cover body (cover sheet) 213 are bent along the peripheral edge 203 of the front cover 201, while if the switching member 80 is not pressed by the pressing screw shaft 30 the inner layer frame 51 is moved downwards to contact the processing platform 155 of the second pressed mold 140, the processing platform 155 is pressed down against the elasticity of the elastic member 156, and the peripheral edge 203 of the front cover 201 is bent to a side of the rear cover 205 peripheral edge 209 so that the periphery of the design paper 211 and the cover body (sheet body) 213 are gripped by the peripheral edge 203 of the front cover 201 and the peripheral edge 209 of the rear cover 205.

The badge manufacturing device 1 will now be described in greater detail. The base 2 is integrally formed using synthetic resin and comprises an upper wall 3 and a peripheral wall 5 formed in a curved fashion at the peripheral edge of the upper wall 3, and a substantially angular U-shaped guide groove 6 extending in a front to rear direction is formed on the upper wall 3. The guide groove 6 has a bottom wall 7 and side walls 9 and 10, with guide protuberances 9*a* and 10*a* being formed on upper parts of the side walls 9 and 10.

Also, bosses 11 and 12 having substantially the same height as the bottom wall 7 of the guide groove 6 are formed at a substantially central part of the upper wall 3 of the base 2, on either side in a direction orthogonal to the guide groove 6 (lateral direction), sandwiching the guide groove 6. Through holes 11*a* and 12*a* extending to the upper wall 3 are formed in the bosses 11 and 12.

A reinforcing member 15 having a substantially angular U-shaped cross section is formed in the bottom wall 7 of the guide groove 6 of the base 2 in a direction orthogonal to the guide groove 6 (lateral direction). This reinforcement member 15 is made of steel material. The reinforcement member 15 contacts the bosses 11 and 12, and holes 15*a* and 15*b* are formed on either side at positions that are the same as the through holes 11*a* and 12*a* of the bosses 11 and 12. Struts 16 and 17 having a substantially circular cross section are erected on the base 2. The struts 16 and 17 are made of steel material.

One strut 16 has a male screw section 16*a* formed on a lower part inserted into the through hole 11*a* of the boss 11 and a hole 15*a* of the reinforcement member 15 and is fastened using a nut 18, to be fixed substantially perpendicular to the boss 11 and the reinforcement member 15. The other strut 17 has a male screw section 17*a* formed on a lower part inserted into the through hole 12*a* of the boss 12 and a hole 15*b* of the reinforcement member 15 and is fastened using a nut 19, to be fixed substantially perpendicular to the boss 12 and the reinforcement member 15.

A fixing member 20 having a substantially square cross section is fixed substantially horizontally to an upper part of the base 2 via the struts 16 and 17. The fixing member 20 is made of steel material. One strut 16 has a male screw section 16*b* formed on an upper part inserted into a hole 20*a* formed in one end of the fixing member 20 and is fastened using a nut 21, so as to be fixed to the fixing member 20. The other strut 17 has a male screw section 17*b* formed on an upper part inserted into a hole 20*b* formed in the other end of the fixing member 20 and is fastened using a nut 22, so as to be fixed to the fixing member 20.

The fixing member 20 has a through hole 23 formed substantially at the center, and a female screw section 25 is fixedly attached substantially coaxially with this through hole 23. It is also possible to form the female screw section directly in the through hole 23. The pressing screw shaft 30 is passed through the through hole 23 and screwed into the female screw section formed in this fixing member, so as to be capable of movement in the axial direction. An attachment section 31 is formed on an upper part of the pressing screw shaft 30, and the operating handle 32 is fixedly attached to this attachment section 31 using a screw 33.

A pressing mold 40 for engaging with a first pressed mold or a second pressed mold, which will be described later, is provided on a lower end of the pressing screw shaft 30. The pressing mold 40 comprises a vertical sliding member 41 formed in a substantially diamond shape, an outer layer frame 42, and an inner layer frame 51, provided inside the outer layer frame 42 and being shallower than the outer layer frame 42. The outer layer frame 42 comprises an outer curved section 45, an outer neck section 46 formed on an upper part of the outer curved section 45, a peripheral wall 47 formed on a lower peripheral edge of the outer curved section 45, and a pressing section 50 formed on a lower end of the peripheral wall 47, with a guide hole 49 being formed in the outer neck section 46 and this guide hole 49 connecting with an opening 43 formed on an upper end 48 of the outer neck section 46.

The inner layer frame 51 comprises an inner curved section 52 engaging with the outer curved section 45 of the outer layer frame 42, a contact edge 53 formed at a lower edge of the inner curved section 52 and contacting the peripheral edge 203 of the badge front cover 201, described later, an inner neck section 55 formed at an upper part of the inner curved section 52, slidably guided in the guide hole 49 of the outer neck section 46 and having an upper end 58 that is positioned at substantially the same position as the upper end 48 of the outer neck section 46 if the inner curved section 52 engages with the outer curved section 45, a protuberance 57 formed substantially in the center of the upper end 58 of the upper wall 56 of the inner neck section 55, and a through hole 59 formed substantially centrally in the upper wall of the inner neck section 55 and stretching to an upper end 60 of the protuberance 57.

The pressing screw shaft 30 has a spindle 35 formed centrally at a lower end, and a screw hole 36 is formed in a lower end of this spindle 35. A pressing member 61 is provided on a lower part of the pressing screw shaft 30. The pressing member 61 comprises a bottom wall 62, a peripheral wall 63 provided around the bottom wall 62, and an annular flange section 65 provided on an upper part of the peripheral wall 63, a through hole 66 is formed in the center of the bottom wall 62, and the spindle 35 is passed through the through hole 66 and rotatably attached to the pressing screw shaft 30 so as to cover the lower part of the pressing screw shaft 30.

Further, the inner layer frame 51 is rotatably provided on the lower end of the pressing screw shaft 30 by passing the spindle 35 of the pressing screw shaft 30 through the through hole 59 of the inner layer frame 51 and screwing a screw 69 into the screw hole 36 of the spindle 35. The pressing member 61 is formed with the peripheral wall 63 having substantially the same outer diameter as the inner neck section 55 of the inner layer frame 51, so that the pressing member 61 can be inserted into the guide hole 49 from the opening 43 formed in the upper part of the outer layer frame 42. Accordingly, the inner layer frame 51 is rotatably provided on the lower end of the pressing screw shaft 30 via the opening 43 formed in the upper part of the outer layer frame 42.

The vertical sliding member 41 is formed in a plate shape and has guide indents 71 and 72 for slidably engaging with the struts 16 and 17 provided at the left and right ends, and is guided so as to only be able to move up and down by these guide indents 71 and 72. An indication plate 73 for enabling confirmation of the positions of these guide indents is integrally formed on a right end of the vertical sliding member 41. A switching member 80 for switching to the outer layer frame 42 or the inner layer frame 51 using the pressing screw shaft 30 according to the position of the first pressed mold or the second pressed mold is provided on the pressing mold 40. A bearing section 75 is formed in the pressing mold 40 (or the vertical sliding member 41), and the switching member 80 is rotatably attached to this bearing section 75 via a screw 76. The switching member 80 comprises a boss section 81 rotatably attached to the bearing section 75 using the screw 76, a first arm section 82 provided on the boss section 81, a semi-ring shaped engagement section 83, provided on the first arm section 82, for engaging with the protuberance 57 of the inner layer frame 51, and a second arm section 87 provided at a position of the boss section 81 substantially opposite to the first arm section 82, and an elongated hole shaped engagement groove 86 is formed in the second arm member 85.

A rocking member 90 is providing in a freely rocking manner on one strut 16 so as to move up and down together with the pressing mold 40. The rocking member 90 is made up of a boss section 91 attached to the strut 16, an arm section 92 provided on one side of the boss section 91, and a spring receiving hook 93 provided on the other side of the boss section 91. An engagement shaft 95 is formed substantially vertically on the arm section 92. The engagement shaft 95 has an upper section 95*a* engaging with the engagement groove 86 of the switching member 80, and a lower section 95*b* projecting from an elongated hole 44 formed in the vertical sliding member 41.

A spring receiving hook 96 is provided on a rear section of the vertical sliding member 41, a spring 97 is placed between this spring receiving hook 96 and the spring receiving hook 93 of the rocking member 90 and the engagement section 83 of the switching member 80 is brought into contact with a protuberance 57 of the inner layer frame 51 via the rocking member 90 under resilience of this spring 97.

A sliding platform 100 is provided in the guide groove 6 of the base 2 so as to be capable of reciprocating movement. The sliding platform 100 is restricted so as to only move in the forward and backward directions by guide projections 9*a* and 10*a* formed in the side walls 9 and 10 of the guide groove 6. A front wall 101 is provided on a front end of the sliding platform 100, and a lip 102 is provided on the front wall 101. A rear wall 103 is provided on a rear end of the sliding platform 100, and a handle 104 is provided on the rear wall 103.

A first pressed mold 110 and a second pressed mold 140 are provided on either side of the sliding platform 100 in the reciprocation direction. The first pressed mold 110 is made up of a first mounting platform 111 for mounting the front cover 201, and a guide platform 125, provided around the first mounting platform 111, for mounting the design paper 211 and the cover body (sheet body) 213 in an overlapping manner, the guide platform 125 being provided so as to be freely moveable up and down and being urged upwards by the elastic member 113. The first mounting platform 111 comprises a gently curved upper wall 115, a peripheral wall 116 formed on a lower peripheral edge of the upper wall 115, and a cylindrical fixed shaft 117 formed substantially in the center of a lower surface of the upper wall 115.

The first mounting platform 111 has a lower part of the peripheral wall 116 engaged with an annular guide protuberance 118 provided on the sliding platform 100, a lower end of the fixed shaft 117 engaged in a concave section 120 of the boss section 119 formed on the sliding platform 100, and is fixed to the sliding platform 100 by passing a screw 122 from the rear surface of the sliding platform 100 through a through hole formed in the sliding platform 100 and screwing into the fixed shaft 117.

The guide platform 125 is formed in an annular shape, and has a ring-shaped mounting section 126 for mounting the design paper 211 and cover body (sheet body) 213 in an overlapping manner, and a guide wall 127, formed at a peripheral edge of the mounting section 126, for guiding peripheral edges of the design paper 211 and the cover body (sheet body) 213, formed at an upper section. A pressing section 50 of the outer layer frame 42 engages with the guide wall 127 of the guide platform 125, and the pressing section 50 is pressed into contact with the mounting section 126. A cylinder 129 sliding up and down along the peripheral wall 116 of the first mounting platform 111 is formed in an inner lower surface of the mounting section 126.

The guide platform 125 also has a guide cylinder 132 for moving the inside of the peripheral wall 116 of the first mounting platform 111 up and down. The guide cylinder 132 has a boss section 131 formed having a guide hole 130 for inserting the fixed shaft 117 of the first mounting platform 111 in a freely sliding manner. A lower end of the guide cylinder 132 and a lower end of the cylinder 129 are integrally linked by a linking lug 133. This linking lug 133 is fitted into a long groove 135 formed by cutting a slot in the peripheral wall 116 of the first mounting platform 111 facing in an up and down direction.

The upper wall 115 of the first mounting platform 111 and the mounting section 126 of the guide platform 125 are roughly the same height, and a gap 136 is formed between the upper wall 115 and the mounting section 126 for insertion of the curved peripheral edge 203 of the front cover 201. The guide platform 125 is urged upwards by a spring (elastic member) 113 wound around the fixed shaft 117 of the first mounting platform 111.

The second pressed mold 140 comprises a second mounting platform 141 for mounting the rear cover 205, and a processing platform 155, provided around the second mounting platform 141, for bending an edge 203 of the front cover 201 to a rear cover 205 edge 209 side so that the design paper 211 and the periphery of the cover body (sheet body) 213 are gripped by the edge 203 of the front cover 201 and the edge 209 of the rear cover 205, the processing platform being capable of upward and downward movement and being urged upwards by an elastic member 156. The second mounting platform 141 is made up of an upper wall 143 formed with a circular indent 142, a peripheral wall 145 formed at a lower peripheral edge of the upper wall 143, and a cylindrical fixed shaft 146 formed substantially in the center of a lower surface of the upper wall 143.

The second mounting platform 141 has a lower part of the peripheral wall 145 engaged with an annular guide protuberance 148 provided on the sliding platform 100, a lower end of the fixed shaft 146 engaged in a concave section 150 of the boss section 149 formed on the sliding platform 100, and is fixed to the sliding platform 100 by passing a screw 152 from the rear surface of the sliding platform 100 through a through hole formed in the sliding platform 100 and screwing into the fixed shaft 146.

The processing platform 155 is formed in an annular shape, with an engagement step section 157 formed on an upper part, a metal ring 159 engaging with this engagement step section 157. An inclined edge 160 is formed on this metal ring 159 for bending the peripheral edge 203 of the front cover 201 to the side of the peripheral edge 209 of the rear cover 205 so as to grip the peripheral edges of the design paper 211 and the cover body (sheet body) 213 between the peripheral edge 203 of the front cover 201 and the peripheral edge 209 of the rear cover 205. It is also possible to form the inclined edge 160 directly on an upper part of the processing platform 155.

An indent 161 for engaging the pressing section 50 of the outer layer frame 42 is provided on an upper part of the inclined edge 160. A cylindrical section 162 sliding up and down along the upper wall 145 of the second mounting platform 141 is formed in a lower part of the engagement step section 157. The processing platform 155 also has a guide cylinder 163 for moving the inside of the peripheral wall of the second mounting platform 141 up and down.

The guide cylinder 163 is formed with a boss section 166 having a guide hole 165 for insertion of the fixed shaft 146 of the second mounting platform 141 in a freely sliding manner. A lower end of the guide cylinder 163 and a lower end of the cylindrical section 162 are integrally linked by a linking lug 167. This linking lug 167 is fitted into a long groove 169 formed by cutting a slot in the peripheral wall 145 of the second mounting platform 141 facing in an up and down direction. The processing platform 155 is urged upwards by a spring (elastic member) 156 wound around the fixed shaft 146 of the second mounting platform 141.

A positioning member 170 for positioning the sliding platform 100 is provided on the base 2. The positioning member 170 is provided in the vicinity of the guide groove 6, has an elastic plate 172 attached using a screw 173, with an engagement projection 175 being formed on a lower surface of the elastic plate. The sliding platform 100 is formed with a first engagement indent 176 and a second engagement indent 177 for engaging with the engagement projection 175 of the elastic plate 172. If the engagement projection 175 of the elastic plate 172 engages with the first engagement indent 176 of the sliding platform 100, the first pressed mold 110 is positioned almost directly below the pressing mold 40, while if the engagement projection 175 of the elastic plate 172 is engaged with the second engagement indent 177 of the sliding platform 100, the second pressed mold 140 is positioned almost directly below the pressing mold 40.

Also, an engagement projection 158 for engaging with the low part 95*b* of the engagement shaft 95 of the switching member 80 described above is provided on one end of the processing platform 155 of the 140. If the second pressed mold 140 is positioned almost directly below the pressing mold 40 the engagement projection 158 engages with the lower part 95*b* of the engagement shaft 95 of the switching member 80, the half-ring shaped engagement section 83 rotates against the elasticity of the spring 97 with the bearing section 75 as a center, and the engagement projection 158 moves away from the protuberance 57 of the inner layer frame 51 of the pressing mold 40.

Reference numeral 180 is a cover. The cover 180 is attached to the base 2 using a screw or the like, first and second openings 181 and 182 are formed in a front section and a rear section so that sliding of the sliding platform 100 is not obstructed, the first pressed mold 110 appears from the first opening 181 and the second pressed mold 140 appears from the second opening 182. An elongated hole making it possible to see the indication plate 73 of the vertical sliding member 41 is formed in the cover 180, and it is possible to confirm the position of the pressing mold 40 by looking at the indication plate 73 from the elongated hole. Reference numeral 190 is a cover provided on the rear surface of the base 2 for covering the reinforcement member 15.

Operation of the badge manufacturing device 1 of the present invention will now be described. If the handle 102 provided on the front wall 100 of the sliding platform 100 is held the first pressed mold 110 taken out from the first opening 181 of the cover 180 and the front cover 201 placed on the upper wall 115 of the first mounting platform 111, the peripheral edge 203 is inserted into the gap 136 between the upper wall 115 and the mounting section 126. Next, after overlapping the cover body (sheet body) 213 on the design paper 211, the design paper 211 is placed on the mounting section 126 of the guide platform 125.

If the handle 102 of the front wall 101 is held and the sliding platform 100 pressed in, the engagement projection 175 of the elastic plate 172 engages with the first engagement indent 176 of the sliding platform 100, the first pressed mold 110 is positioned almost directly below the pressing mold 40 and the second pressed mold 140 projects from the second opening 182 of the cover 180. If the operating handle 32 is turned in one direction, the pressing screw shaft 30 is rotated clockwise and the pressing screw shaft 30 moves downwards. The pressing member 61 provided on the lower part of the pressing screw shaft 30 presses down on the entire pressing mold 40, namely the outer layer frame 42 and the inner layer frame 51 via the engagement section 83 of the switching member 80. Accompanying this, the vertical sliding member 41 slides downwards.

The pressing section 50 of the outer layer frame 42 engages with the guide wall 127 of the guide platform 125, contacts the mounting section 126 and the guide platform 125 is pressed downwards against the resilience of the elastic member 156. Since the inner layer frame 51 is shallower than the outer layer frame 42, it does not touch the first pressed mold 110, the peripheries of the cover body (sheet body) 213 and the design paper 211 placed on the guide platform 125 in an overlapping manner are bent downwards, and come into contact with the peripheral edge 203 of the front cover 201 placed on the first mounting platform 111. The position where this pressing mold 40 has been pressed downwards can be confirmed by looking at the indication plate 73.

If the operating handle 32 is turned in the other direction, the pressing screw shaft 30 rotates anticlockwise and the pressing screw shaft 30 moves upwards. Accompanying this, the whole of the pressing mold 40 moves upwards and the vertical sliding member 41 also slides upwards. The front cover 201 in a state where the peripheries of the cover body (sheet body) 213 and the design paper 211 are bent downwards and are in contact with the peripheral edge 203 is pulled up while still being fitted inside the peripheral wall 47 of the outer layer frame 42 and is detached from the first pressed mold 110.

If the rear cover 205 is mounted on the upper wall 143 of the second mounting platform 141 of the second pressed mold 140 projecting from the second opening 182 of the cover 180, with the peripheral edge 209 facing upwards, the attachment hole 207 for attaching the detachable pin 210 is protected by the indent 161 and the peripheral edge 209 is guided and positioned in an inner surface of the cylindrical section 162 of the processing platform 155.

If the handle 104 of the rear wall 103 is held and the sliding platform 100 pushed down, the engagement projection 175 of the elastic plate 172 engages with the second engagement indent 177 of the sliding platform 100, the second pressed mold 140 is positioned almost directly below the pressing mold 40 and the first pressed mold 110 projects from the first opening 181 of the cover 180. If the second pressed mold 140 is positioned almost directly below the pressing mold 40, the engagement projection 158 engages with the lower section 95*b* of the engagement shaft 95 of the switching member 80, the semi-ring shaped engagement section 83 rotates against the resilience of the spring 97 with the bearing section 75 as a center, and moves away from the projection 57 of the inner layer frame 51 of the pressing mold 40.

If the operating handle 32 is turned in the one direction, the pressing screw shaft 30 rotates clockwise and the pressing screw shaft 30 moves downwards. The pressing member 61 provided on the lower part of the pressing screw shaft 30 then presses down on the inner layer frame 51 of the pressing mold 40. The contact edge 53 of the inner layer frame 51 contacts the upper edge of the front cover 201 and the front cover 201 is pushed down. The peripheries of the cover body (sheet body) 213 and the design paper 211 in contact with the peripheral edge 203 of the front cover 201 are bent inwards while in contact with the inclined edge 160 of the processing platform 155, the peripheral edge 203 of the front cover 201 is pressed against the inclined edge 160 and the processing platform 155 is pushed downwards against the resilience of the resilient member 156.

If the lower end of the processing platform 155 comes into contact with the sliding platform 100 to push the processing platform 155 downwards, the peripheral edge 203 of the front cover 201 is bent further inwards by the inclined edge 160 and the peripheries of the cover body (sheet body) 213 and the design paper 211 are gripped between the peripheral edge 209 of the rear cover 205 and the peripheral edge 203 of the front cover 201 to manufacture the badge body 200*a*.

If the operating handle 32 is turned in the other direction, the pressing screw shaft 30 turns anticlockwise and the pressing screw shaft 30 moves upwards. Accompanying this, the entire pressing mold 40 moves upwards and the vertical sliding member 41 also slides upwards. The badge body 200*a* remains loaded in the second pressed mold 140. The handle 104 provided in the rear wall 103 of the sliding platform 100 is held, the second pressed mold 140 is taken out from the second opening 182 of the cover 180, and it is possible to simply remove the badge body 200*a* from the second pressed mold 140.

The above described badge manufacturing device forms a substantially square shaped frame using the fixing member 20, struts 16 and 17 and reinforcement member 15, which means that strength is increased and it is possible to perform press operations with this strong inner frame. Therefore, members other than the fixing member 20, struts 16 and 17 and reinforcement member 15 can be integrally formed using synthetic resin, so the apparatus can be made lightweight and at reduced cost, and it is possible to improve productivity.

Also, if the pressing screw shaft 30 is turned, the pressing mold 40 is lowered, the first pressed mold 110 or the second pressed mold 140 is relatively raised and the badge body 200*a* is manufactured using pincer force from both the pressing mold 40 and the first pressed mold 110 or the second pressed mold 140. Therefore, the base 2 is not squeezed and it is not necessary to place the base at a stable location and it is also possible to carry out operation with the base 2 at an unstable place, such as while being held. Also, since the pressing screw shaft 30 is used in pressing the pressing mold 40 it is possible to reduce the operating space.

Manufacture of the badge 200 is completed upon inserting the attachment shaft 221 (or 231, 241) of the previously described linking means 220 (or 230, 240) in the attachment hole 207 of the badge body 200*a* and linking them. This linking can be carried out by confirming the orientation of the representation 215 attached to the badge body 200*a*, and when the badge is mounted at a suitable position of an article such as a clothes pocket, a hat or a bag, selecting a direction (for example the X direction, Y direction or Z direction in FIG. 9) of mounting means, such as a detachable pin, 229, gripping plate 237, that crosses the rear surface plate of the badge body 200*a* so that orientation of the representation is appropriate. For this reason, it is possible to manufacture the badge body 200*a* without paying attention to the relationship between orientation of the representation 215, printed on the design paper 211 attached to the front cover 201, and the position of the mounting means 229, 237, 246 attached to the rear cover 205.

INDUSTRIAL APPLICABILITY

As has been described above, the badge of the present invention has the effect of making it possible to select attachment position of mounting means such as a detachable pin for mounting the badge on an article according to orientation of a representation attached to the badge body, because it is possible to link the badge to the badge body by selecting an attachment position of mounting means such as a detachable pin or clip etc, for mounting the badge of an article the badge is to be worn on, such as clothing, a hat or a bag, so as to be in a direction to cross a rear surface plate of the badge body while confirming the orientation of the representation, which is characters or a design attached to the badge body. Therefore, when manufacturing a badge body with a conventional badge manufacturing device it was necessary to carry out manufacture while confirming a relationship between orientation of the representation attached to the badge body and the position of mounting means, but using the structure of the badge of the present invention, labor normally expended confirming the relationship between orientation of the representation and position of the mounting means can be eliminated from manufacture, manufacture is simplified, and there is the effect of not manufacturing defective product where the relationship between representation orientation and position of the mounting means is inappropriate.

Also, the badge of the present invention can be attached to a badge body by selecting one from a number of mounting means, such as a detachable pin, a clip or a magnet, which means that it is possible to select the method of attachment in line with the article the badge is to be worn on, such as clothing, a hat or a bag.

The badge manufacturing device of the present invention has increased strength with formation of a substantially square frame using a reinforcement member and a press operation is carried using this strengthened frame which means that members besides the reinforcement member, such as a fixing member, struts etc., can be made of synthetic resin, making the device lightweight and inexpensive, and it is possible to improve productivity.

Also, since, if the pressing screw shaft is turned, the pressing mold is lowered, the first pressed mold or the second pressed mold is relatively raised and the badge body is manufactured using pincer force from both the pressing mold and the first pressed mold or the second pressed mold. It is possible to use the base without it being attached to an installation platform such as a desk, and it is not necessary to install the base at such a stable location and it is also possible to carry out operation with the base at an unstable place, such as while being held. Also, since the pressing screw shaft is used in pressing the pressing mold it is possible to reduce the operating space. In this way, it is possible to have a robust device that is lightweight and enables space reduction, where operation can be carried out without the need for unreasonable force in an unstable place, which means it can even be used simply by a child.

The invention claimed is:

1. A badge comprising:

a front cover, having a substantially circular front surface plate and a front cover edge extending farther down than the front surface plate, a sheet body mounted on the front surface plate of the cover, a badge body comprising a rear cover having a substantially circular rear surface plate and a rear cover edge extending farther upward than the rear surface plate, fitting into the front cover so as to grip an edge of the sheet body between the rear cover edge and the front cover edge causing the sheet body to be tightly connected to the front surface plate, the rear cover having an attachment hole in a substantially central part of the rear cover, latch claws at the peripheral edge of the attachment hole, linking means having an attachment shaft at a substantially central part of the linking means, the attachment shaft fitting into the attachment hole and held by the latch claws mounting means, for mounting the badge on an object, crossing the rear cover plate and selectively linking to the badge body after formation of the badge body by fitting the rear cover and the front cover together.

2. The badge of claim 1, having a design paper printed with a representation that is characters, a pattern or a design, or a combination of these, placed between the front surface plate of the front cover and the sheet body; and selection of orientation of the mounting means to cross the rear surface plate is determined using appropriateness of the representation in the case where the mounting means has been mounted at an appropriate position of an object the badge is worn on.

3. The badge of claim 1 having mounting means selected from a detachable pin, a clip or a magnet.

* * * * *